United States Patent [19]

Bauer et al.

[11] 3,935,473

[45] Jan. 27, 1976

[54] SOLID STATE STACK SWITCH CONTROL SYSTEM

[75] Inventors: Frederick T. Bauer; Anthony C. Cairo; Ronald E. Holkeboer, all of Holland; Gary E. Tyler, Wyoming, all of Mich.

[73] Assignee: Robertshaw Controls Company, Richmond, Va.

[22] Filed: June 24, 1974

[21] Appl. No.: 482,203

Related U.S. Application Data

[63] Continuation-in-part of Ser. No. 422,225, Dec. 6, 1973, abandoned.

[52] U.S. Cl. ..... 307/117; 431/78

[51] Int. Cl.[2] ..... H01H 47/26

[58] Field of Search ..... 307/116, 117; 431/78; 335/205; 200/81.9 M, 83 L; 337/134, 54, 90, 344

[56] References Cited

UNITED STATES PATENTS

| | | | |
|---|---|---|---|
| 2,313,072 | 3/1943 | Hotchkiss | 431/78 X |
| 3,193,198 | 7/1965 | Carlson | 335/205 X |
| 3,445,796 | 5/1969 | Spiroch et al. | 335/205 |
| 3,624,407 | 11/1971 | Bauer | 307/116 |

*Primary Examiner*—James R. Scott
*Assistant Examiner*—M. Ginsburg
*Attorney, Agent, or Firm*—Malcolm R. McKinnon

[57] ABSTRACT

A solid state stack switch control system for furnaces and the like including burner control means, means including solid state means effective to control said burner control means in response to thermally actuated, magnetically operated heat detection means, line voltage safety switch means, and means for interfacing between an isolated low voltage control circuit and said burner control means.

7 Claims, 16 Drawing Figures

SOLID STATE STACK SWITCH CONTROL SYSTEM

BRIEF SUMMARY OF THE INVENTION

This application is a continuation-in-part of the applicants' co-pending application, Ser. No. 422,225, filed Dec. 6, 1973 for Solid State Stack Switch Control System, now abandoned.

This invention relates to stack switch control systems for furnaces and the like and, more particularly, to an improved solid state stack switch control system incorporating improved thermally actuated, magnetically operated heat detecting switch means effective to control and supervise furnace burners and the like.

Heretofore, stack switch controls have been utilized to control and supervise burners in furnaces, such stack switch controls controlling the furnace burner in response to the detection of heat in the furnace stack and supervising the furnace to insure safe combustion in the furnace's combustion chamber and shutting the burner off if an unsafe condition occurs. However, prior stack switch controls of the indicated character have been subject to defects due to a multiplicity of cumbersome electrical contacts and current paths, and are susceptible to corrosion and wear of mechanical components thereby reducing the service life thereof.

An object of the present invention is to overcome the aforementioned as well as other disadvantages in prior stack switch controls and to provide improved solid state stack switch control system for furnaces incorporating thermally actuated, magnetically operated heat detecting switch means that provides improved furnace burner control and supervision from the furnace stack.

Another object of the invention is to provide an improved solid state stack switch control system for furnaces incorporating improved thermally actuated, magnetically operated switch means.

Another object of the invention is to provide an improved solid state stack switch control system for furnaces operable to control a furnace burner in response to the detection of heat in a furnace stack and to deenergize the burner in the event an unsafe condition occurs.

Another object of the invention is to provide an improved solid state stack switch control system for furnaces that has fewer moving parts and is less susceptible to corrosion and wear than prior stack switch controls, and is more durable, efficient and reliable in operation and more readily adaptable to meet the control and supervision requirements of various types of furnaces than prior stack switch controls.

Another object of the invention is to provide an improved solid state stack switch control which may be marketed in the form of a universal service kit which can replace either a worn-out or defective stack switch control; a cadmium cell flame detector type primary control; or be used to perform a stack switch type to cadmium cell flame detector type conversion.

Another object of the invention is to provide an improved solid state stack switch control incorporating readily detachable, easily replaceable components as well as improved step control means.

The above as well as other objects and advantages of the present invention will become apparent from the following description, the appended claims and the accompanying drawings.

BRIEF DESCRIPTION OF THE DRAWINGS

FIG. 6 is a transverse cross-sectional view of the structure illustrated in FIG. 5;

FIG. 4 is a schematic view of the structure illustrated in FIG. 11, illustrating the switch in the open position.

Detailed Description

Figure 1:
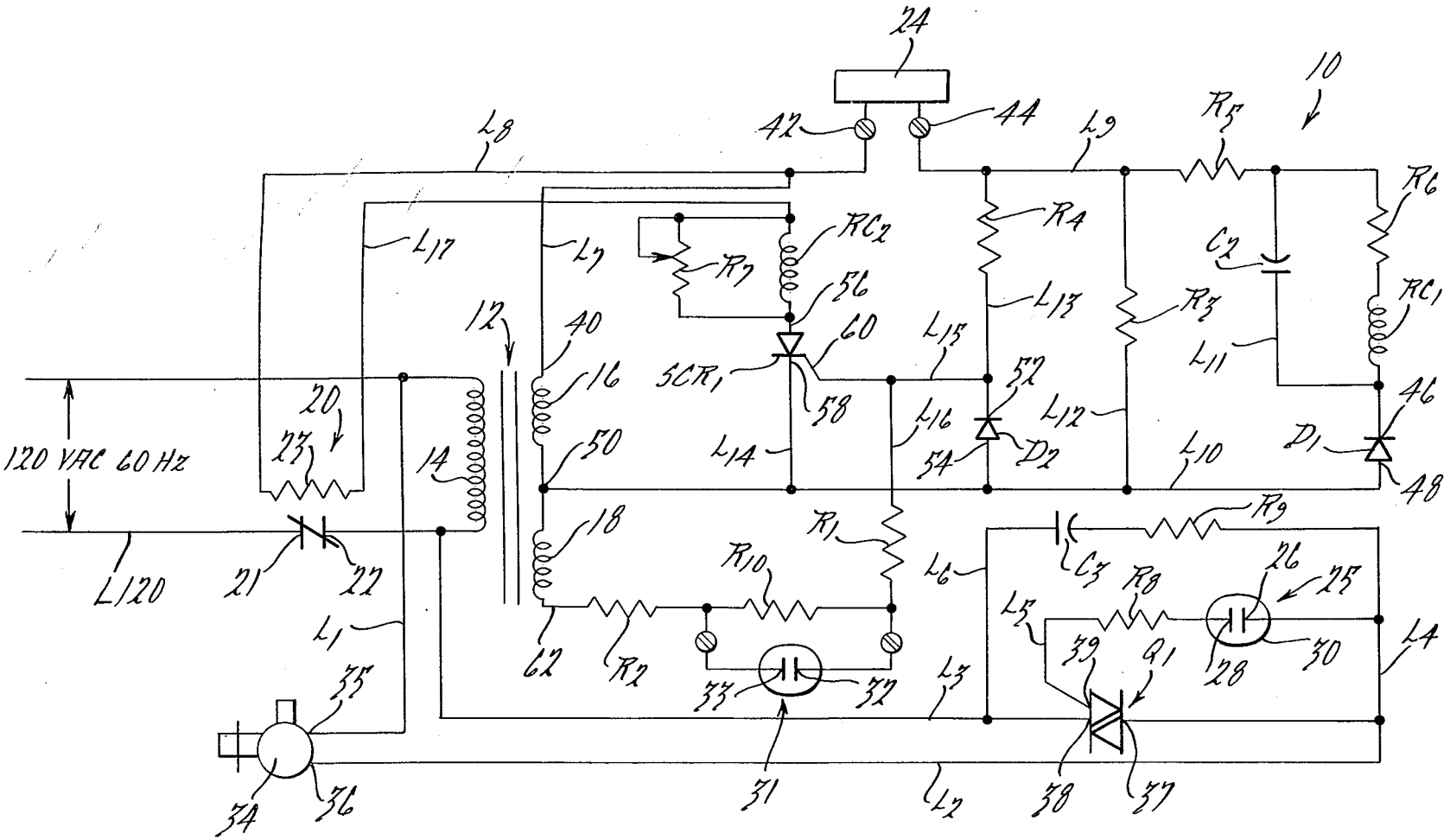
FIG. 1 is a schematic circuit diagram of a solid state stack switch control system illustrating one embodiment of the present invention.

Referring to the drawings, and more particularly to FIG. 1 thereof, the circuitry for a solid state stack switch control system, generally designated 10, embodying the present invention is schematically illustrated. As shown in FIG. 1, the solid state stack switch control system 10 is comprised of a step down transformer 12 having a primary winding 14 and secondary windings 16 and 18, the primary winding 14 being adapted to be connected to a conventional source of 120 volt alternating current while, in the embodiment of the invention illustrated, each of the secondary windings 16 and 18 of the isolated step down transformer preferably has a potential of approximately 8 volts AC. The system 10 also includes a line voltage safety switch, generally designated 20, including normally closed contacts 21 and 22 and a heater coil 23; a conventional thermostat generally designated 24; a reed switch generally designated 25, having contacts 26 and 28 being enclosed within a hermetically sealed glass envelope 30 while the coils RC1 and RC2 are concentrically wound therearound; a triac Q1 and a silicon controlled rectifier SCR1. The system 10 also includes a second reed switch 31 which will be described hereinafter in greater detail, the switch 31 having contacts 32 and 33. The system 10 also includes resistors R1, R2, R3, R4, R5, R6, R8, R9, and R10; capacitors C2 and C3; a potentiometer R7 and diodes D1 and D2. As shown in FIG. 1, the solid state stack switch control system 10 is connected to and adapted to control and supervise a conventional burner 34 of a furnace (not shown). The terminal 35 of the burner 34 is connected to the source of power by the lead L1 while the terminal 36 of the burner is connected to the terminal 37 of the triac Q1 by the lead L2, the terminal 38 of the triac Q1 being connected to the source of power by the lead L3. The contact 26 of the reed switch 25 is connected by the lead L4 to the lead L2 while the contact 28 is connected to the gate 39 of the triac Q1 through the resistor R8 by the lead L5, the resistor R9 and the capacitor C3 being connected across the leads L2 and L3 by the leads L4 and L6 to protect the triac Q1.

The normally closed contacts 21 and 22 of the safety switch 20 are connected to and adapted to make and break the high voltage lead L120 connected to the primary winding 14 of the transformer 12.

The terminal 40 of the secondary winding 16 is connected to the heater coil 23 of the safety switch 20 and to the terminal 42 of the thermostat 24 by the leads L7 and L8, the terminal 44 of the thermostat 24 being connected by the lead L9 through the resistors R5 and R6 and the coil RC1, to the terminal 46 of the diode D1. The terminal 48 of the diode D1 is connected to the center tap 50 of the secondary windings of the transformer 12 by the lead L10. The capacitor C2 is connected across the resistor R6 and the coil RC1 of the reed switch 25 by the lead L11 while the resistor R3 is connected between the leads L9 and L10 by the lead L12 as illustrated in FIG. 1. The terminal 44 of the thermostat 24 is also connected to the terminal 52 of the diode D2 by the lead L13 through the resistor R4, the terminal 54 of the diode D2 being connected to the center tap 50 of the transformer 12 by the lead L10. As shown in FIG. 1, the heater coil 23 of the safety switch 20 is connected to the terminal 56 of the silicon controlled rectifier SCR1 through the coil RC2 of the reed switch 25 by the lead L7, the potentiometer R7 being connected across the coil RC2. The terminal 58 of the silicon controlled rectifier SCR1 is connected to the center tap of the transformer 12 by the leads L14 and L10 while the gate 60 of the rectifier SCR1 is connected to the terminal 52 of the diode D2 by the lead L15 and to the terminal 62 of the secondary winding 18 of the transformer by the lead L16 through the resistor R1, the reed switch 31 through the contacts 32 and 33 thereof, and the resistor R2, the resistor R10 being connected across the reed switch 31 and functioning to stabilize the silicon controlled rectifier SCR1.

The above described components are preferably mounted on a circuit board which may be integrated, and mounted within a housing as will be described hereinafter in greater detail.

Referring in greater detail to the components of the system 10, the safety switch 20 illustrated schematically in FIG. 1 may be of the type disclosed in U.S. Pat. No. 3,848,211 of William R. Russel entitled "Electrical Switch Construction and an Electrical Control System Utilizing the Same or the Like" although, if desired, other types of safety switches may be utilized. In general, the switch 20 is constructed and arranged in a manner such that should the system 10 detect that the burner 34 has not ignited within a predetermined time period, the system 10 will cause the contacts 21 and 22 to open to break the high voltage line L120. Such opening of the contacts may be effected, for example, by heating a bimetallic latch member (not shown) through the agency of the heating coil 23, the bimetallic latch member being effective to maintain the contacts 21 and 22 in a closed condition until the latch member is heated to a predetermined extent by the heating coil 23, as described in detail in the aforementioned patent. As will be described hereinafter in greater detail, when the system 10 is initially energized by the thermostat 24 calling for heat, electrical current is adapted to flow through the heating coil 23 whereby the heating coil tends to heat the latching member if the switch 20. However, if the burner 34 ignites during such time period, the stack switch control embodying the present invention senses heat in the furnace stack and the system deenergizes the electrical heater coil 23 whereby the contacts 21 and 22 remain in the closed condition to maintain an electrical circuit through the high voltage line 65. However, if during such predetermined time period the burner 34 is not ignited, the heater coil 23 will remain energized whereby the latching member of the switch 20 is sufficiently heated to cause the contacts 21 and 22 to open and break the high voltage line L120 to terminate the flow of current to the burner 34 and thus turn off the burner until the switch 20 is reset.

Referring now to FIGS. 2 through 8, the reed switch 31 is incorporated in a stack switch control assembly, generally designated 70, embodying the present invention. The stack switch control assembly 70 is comprised of an elongate tubular body 72 which is preferably formed of metal and which defines an axially extending passageway 74 that extends throughout the length of the tubular body 72. One end portion 76 of the tubular body 72 is fixed to a junction box 78, as by flanges 80 and 82 secured to the front wall 84 of the junction box, as by screws 86, or other suitable fastening means. The junction box 78, in turn, carries a housing 88 adapted to contain the transformer 12, safety switch 20 reed switch 25, the triac Q1, rectifier SCR1 and the various resistors, capacitors and diodes hereinbefore described.

The other end portion 90 of the tubular body 72 is adapted to be mounted on and project into a furnace stack 92 through which the flue gases pass, the central portion 94 of the tubular body 72 being fixed to the exterior wall 96 of the stack 92 as by a mounting bracket 98 or other suitable means effective to mount the assembly 70 on the stack 92.

Figure 2:
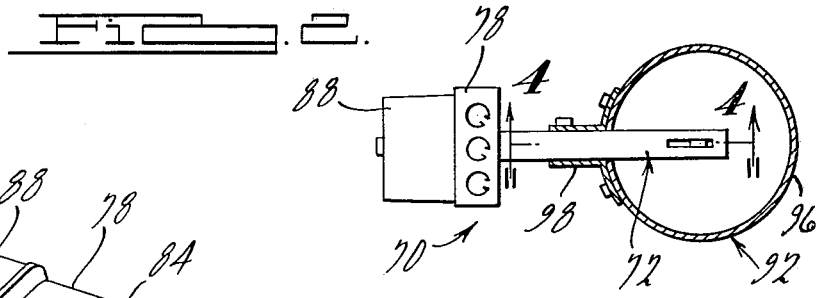
FIG. 2 is an elevational view, with portions in cross-section, of the improved stack switch incorporated in the system illustrated in FIG. 1, showing the same installed in a furnace stack.
Figure 3:
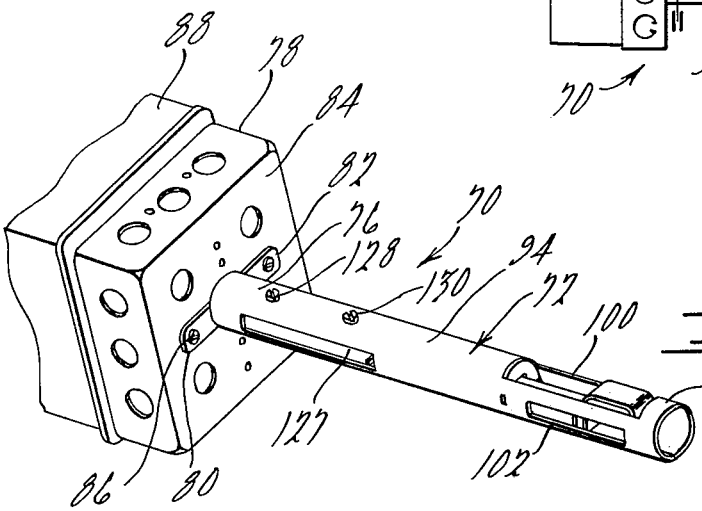
FIG. 3 is a perspective view of the switch illustrated in FIG. 2.
Figure 4:
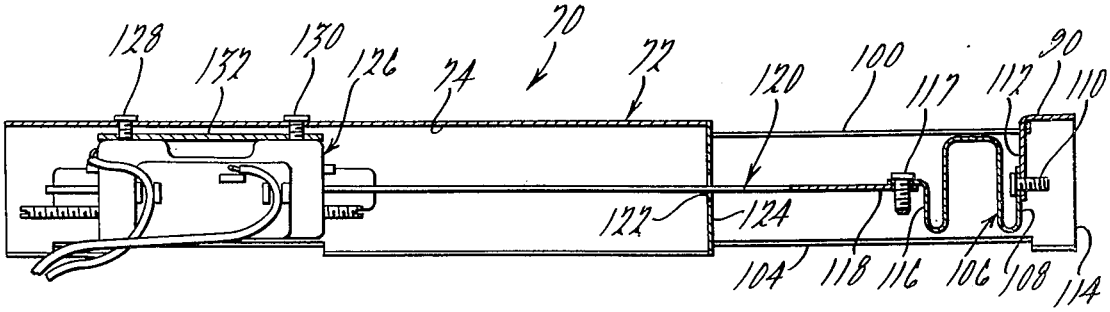
FIG. 4 is a longitudinal, cross-sectional view of the structure illustrated in FIG. 2, taken on the line 4—4 thereof.

As shown in FIGS. 2, 3 and 4, the end portion 90 of the tubular body 72 which projects into the stack 92 defines equally angularly spaced, circumferentially disposed, elongate slots, such as 100, 102 and 104 which permit the flue gases to circulate through such end portion of the tubular body 72. A bimetallic actuating member 106 of generally serpentine or sinuous configuration is provided which is mounted in the passageway 74 adjacent the slots 100, 102 and 104, one end portion 108 of the bimetallic member 106 being fixed, as by a screw 110, to a flange portion 112 of the body 72 projecting into the passageway 74 at a position near but spaced from the end 114 thereof. The other end portion 116 of the serpentine bimetallic member 106 is fixed, as by a screw 117, to one end portion 118 of an elongate substantially straight drive arm 120 which is formed of magnetic material, such as steel, and which, in the preferred embodiment of the invention illustrated, is of rectangular cross section although, if desired, other cross sectional configurations may be utilized. The drive arm 120 extends longitudinally of the passageway 74 through an opening 122 in a bearing wall 124 carried by the body 72.

Figure 5:
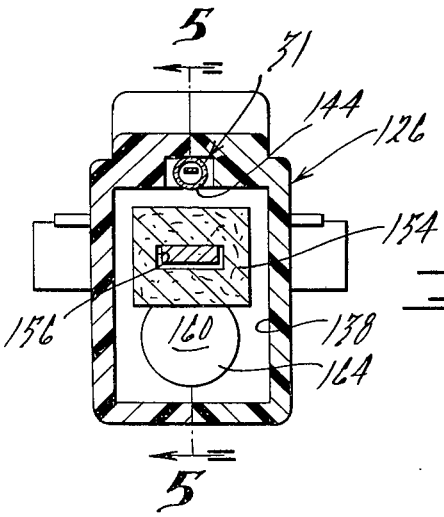
FIG. 5 is an enlarged longitudinal cross-sectional view of the switch structure illustrated in FIG. 4.
Figure 5:
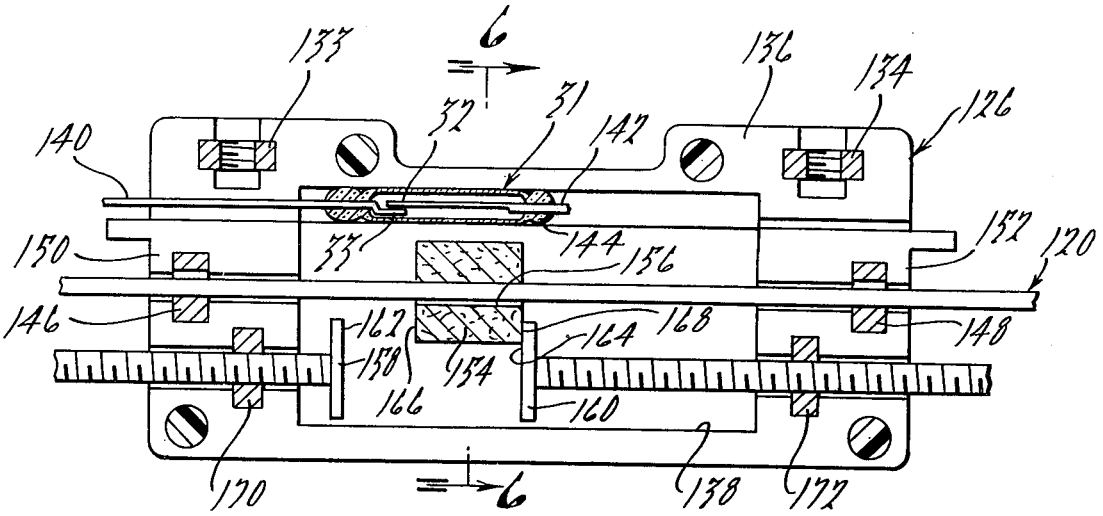

As shown in FIG. 4, 5 and 6, a switch housing 126 is provided which may be formed of plastic or other suitable material having sufficient strength to withstand the forces exerted thereon. The switch housing 126 is mounted in the passageway 74 adjacent the end portion 76 of the tubular body 72, suitable diametrically opposed openings, such as 127, being provided in the tubular body 72 to facilitate access to the switch housing. The switch housing 126 is secured to the tubular body 72 by screws, such as 128 and 130, which pass through the outer wall of the tubular body and a mounting plate 132, the screws threadably engaging nuts, such as 133 and 134, embedded in the top wall 136 of the housing 126. The housing 126 defines a chamber 138 in which the reed switch 31 is mounted by any suitable means, such as an adhesive, adjacent the top wall 136 as shown in FIGS. 5 and 6. As previously mentioned, the reed switch 31 is comprised of the contacts 32 and 33 which are carried by reeds 140 and 142 hermetically sealed within a glass envelope 144. As shown in FIGS. 5 and 6, the drive arm 120 passes through the chamber 138 of the housing 126 at a position near but below the reed switch 31, the longitudinal axis of the drive arm 120 being disposed in vertical alignment with the longitudinal axis of the reed switch 31. The drive arm 120 is supported by bearing members, such as 146 and 148, carried by the end walls 150 and 152, respectively of the housing 126.

As shown in FIGS. 5 and 6, a magnet 154 is provided which is preferably formed of ceramic or other relatively non-corrosive material. In the preferred embodiment of the invention illustrated, the magnet 154 is of generally cubic configuration and defines an axially extending passageway 156, the minimum cross sectional dimensions of which are greater than the maximum corresponding cross sectional dimensions of the drive arm 120, and the magnet 154 is slideably mounted on the drive arm 120 and within the chamber 138 defined by the housing 126, at a position near but slightly spaced below the reed switch 31. As shown in FIGS. 5 and 6, the drive arm 120 passes through the magnet 154 with a loose sliding fit, the magnet 154 being magnetically attracted to and magnetically gripping the drive arm 120 which, as previously mentioned, is formed of magnetic material such as steel. With such a construction, the magnet 154 magnetically clutches the drive arm 120 and moves longitudinally with the drive arm 120 but the drive arm 120 is free to move through the magnet when the forces tending to move the drive arm through the magnet are greater than the magnetic attraction between the magnet 154 and the drive arm 120. In the embodiment of the invention illustrated, a pair of adjustable stop members 158 and 160 are provided having abutment surfaces 162 and 164, respectively, disposed within the chamber 138 and adapted to engage the ends 166 and 168, respectively, of the magnet 154 to limit the longitudinal movement of the magnet. The stop members 158 and 160 threadably engage internally threaded members 170 and 172 carried by the housing 126 thereby permitting manual adjustment of the relative positions of the abutment surfaces 162 and 164.

Figure 7:
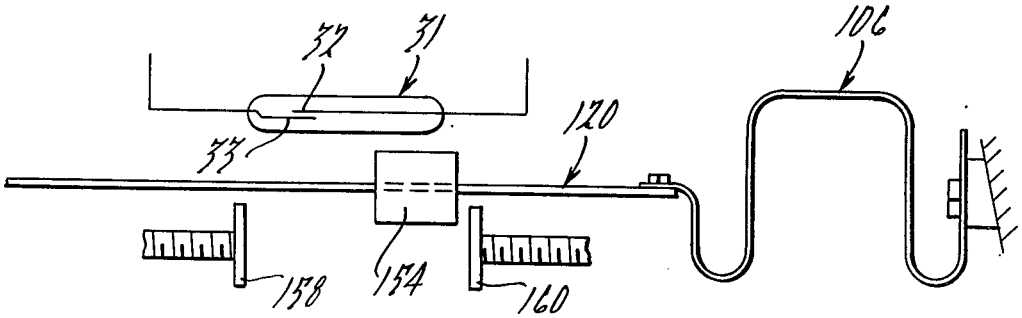
FIG. 7 is a schematic view of the structure illustrated in FIG. 4, illustrating the switch in the open position.

The magnet 154 also functions to open and close the contacts 32 and 33 of the reed switch 31, the reeds 140 aand 142 of which are formed of magnetic material in the conventional manner. When the magnet 154 is disposed adjacent the right end of the reed switch 31 as illustrated in FIG. 5 and as schematically illustrated in FIG. 7, the contacts 32 and 33 are open. However, when the magnet 154 is disposed adjacent the left end of the reed switch 31 as schematically illustrated in FIG. 8, the magnet 154 causes the contacts 32 and 33 to close to complete an electrical circuit through the reed switch 31.

In FIGS. 5 and 7, the control is illustrated in the "off" mode. When the thermostat 24 calls for heat, and assuming that the burner 34 ignites and that the combustion is satisfactory, the hot gases flowing through the furnace stack 92 heat the serpentine bimetallic actuating member 106 and the serpentine bimetallic actuating member 106 moves to the left, as illustrated in FIG. 8, and moves drive arm 120 and the magnet 154 to the position illustrated in FIG. 8. When the magnet 154 reaches the position illustrated in FIG. 8, the magnet 154 closes the contacts 32 and 33 of the reed switch 31 to complete an electrical circuit therethrough and turn off the safety switch 20 as will be described hereinafter in greater detail. As the serpentine bimetallic actuating member 106 becomes hotter, the bimetallic actuating member 106 and the drive arm 120 continue to move to the left, as viewed in FIGS. 7 and 8, but the magnet 154 remains against the stop 158 to maintain the contacts 32 and 33 closed, the drive arm de-clutching from and slipping through the magnet 154 since the forces tending to move the drive arm 120 through the passageway 156 defined by the magnet 154 are greater than the magnetic attraction between the magnet 154 and the drive arm 120. The drive arm 120 is thus free to move longitudinally for any desired distance while the magnet 154 moves with the drive arm only between the limits set by the adjustable stop members 158 and 160.

Figure 8:
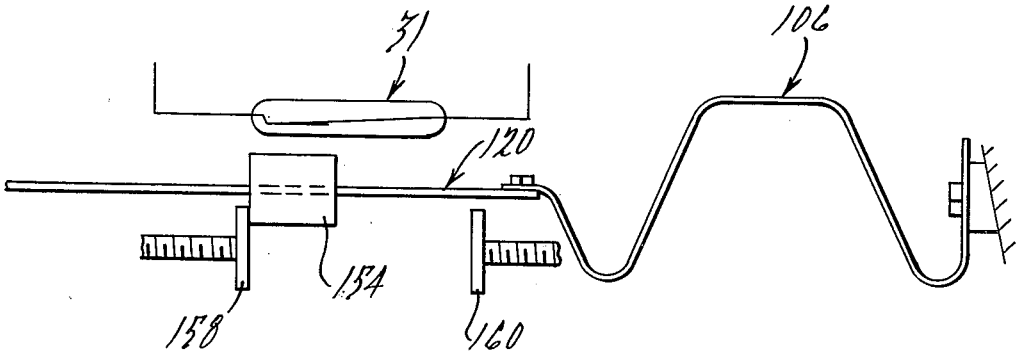
FIG. 8 is a schematic view similar to FIG. 7, illustrating the switch in the closed position.

Assuming that a flame failure occurs while the magnet 154 is disposed in the position illustrated in FIG. 8, the serpentine bimetallic actuating member 106 begins to cool and the actuating member 106 and the drive arm 120 move to the right, as viewed in FIGS. 7 amd 8. The magnet 154 moves with the drive arm due to the magnetic attraction therebetween and when the magnet 154 reaches the position illustrated in FIG. 7, the contacts 32 and 33 open causing the safety switch 20 to energize as will be described hereinafter in greater detail. The movement of the magnet 154 to the right, as viewed in FIGS. 7 and 8, is, of course, limited by the adjustable stop member 160 so that the magnet is maintained in the desired position for proper resetting. From the foregoing it will be appreciated that the magnet 154 also provides damping as well as clutching in addition to actuation of the reed switch 31.

The rectifier SCR1 is a conventional silicon controlled rectifier and may, for example, carry a rating of approximately four amperes. The thermostat 24 may be of any desired or conventional construction while the reed switch 25 is preferably of the type comprised of the pair of contacts 26 and 28 carried by reeds hermetically sealed within a glass envelope 30. The reed switch 25 also includes the electrically insulated, independently wound concentric coils RC1 and RC2, the magnetic fluxes of such coils being additive when in phase. The reed switch 25 preferably has a very large differential between pull-in and drop-out ampere turns or coil power. By way of example, the reeds preferably will pull in at about 60 ampere turns, but will not drop out until below 20 ampere turns, a ratio of approximately 3 to 1. In the embodiment of the invention illustrated in FIG. 1, the maximum power to the coil RC1 is well below that required to pull-in the reed switch and close the contacts 26 and 28. The power is, however, enough to hold the reed switch contacts 26 and 28 closed once pull-in has been establised, due to the very large differential. The reed switch coil RC2, on the other hand, has sufficient power when combined with RC1 to pull in the reed switch. Since the reed switches are very fast they are capable of following an alternating current voltage to open or close 60 or 120 times per second. To avoid this opening and closing and the associated wear, the diode D1 and the capacitor C2 are provided. The diode D1 is preferably a 200 milliampere diode which supplies half wave rectified current to the capacitor C2 to establish a DC supply for the reed switch coil RC1. The capacitor C2 is preferably a 47 microfarad 15 volt DC capacitor. The diode D1 and the capacitor C2 function to form a DC supply for the holding coil RC1 so that flux is always present on the coil RC1 when the thermostat calls for heat. This flux is very small however. With such a construction and since relatively small current passes through the contacts 26 and 28, such contacts are very reliable over a relatively long life.

The triac Q1 is a bidirectional thyrister which may be gate triggered from a blocking to conducting state for either polarity of applied voltage, and is preferably mounted to isolate the other components of the control 10 from the heat generated by the triac Q1. The resistors R1 and R2 are preferably carbon resistors having ratings of 150 ohms and 560 ohms, respectively, one-half watt, the purpose of the resistor R1 being to prevent the accidental destruction of the diode D1, transformer 12 or silicon contrilled rectifier SCR1 by a serviceman in the field. In this connection the resistors R1, R2, R5, R9 and R10, the diode D2 and the capacitor C3 are all provided in the system 10 for the purpose of protecting other components and to protect against erroneous wiring in the field. The resistors R1, R2, R5, R9 and R10, the diode D2 and the capacitor C3 are thus not essential to the basic circuit performance.

Typical values for the components in the control system described above are as follows:

| | |
|---|---|
| SCR1 | 4 AMP Silicon controlled rectifier |
| D1 | 200 Ma diode |
| D2 | 200 Ma diode |
| R1 | Carbon resistor 150 ohms, ± 20%, ½ watt |
| R2 | Carbon resistor 560 ohms, ± 20%, ½ watt |
| R3 | Wirewound resistor 20 ohms, ± 20%, 5 watt |
| R4 | Carbon resistor 3300 ohms, ± 20%, ½ watt |
| R5 | Carbon resistor 47 ohms, ± 20%, ½ watt |
| R6 | Wirewound resistor 680 ohms, ± 20%, 1 watt |
| R7 | Wirewound potentiometer 1 ohm, ± 20%, 2 watt |
| R8 | Carbon resistor 82 ohms, ± 20%, ½ watt |
| R9 | Carbon resistor 82 ohms, ± 20%, ½ watt |
| R10 | Carbon resistor 33000 ohms, ± 20%, ½ watt |
| C2 | Capacitor 47 mfd 15 VDC |
| C3 | Capacitor 22 mfd V Mylar foil |

It will be understood, however, that these values may be varied depending upon the particular application of the principles of the present invention.

Assuming a basic knowledge of the triac Q1 and the silicon controlled rectifier SCR1, a typical thermostat cycle operates in the following manner. It should be noted initially that whenever the reed contacts 26 and

28 are closed, current will flow from the source of electric power through the lead L1, the burner 34, the lead L2, the contacts 26 and 28 and the resistor R8, to the gate of the triac Q1 and the lead L3. When the gate of the triac Q1 is energized the full motor current will then pass through the triac Q1. This starts the burner and has the same effect as closing a set of relay contacts between the lead L2 and the lead L3.

Whenever the thermostat contacts close, a continuous holding flux is established in the coil RC1 by the DC supply network comprised of the diode D1 and the capacitor C2. Current also flows through the resistor R4 to the gate 60 of the silicon controlled rectifier SCR1. If the stack switch control assembly 70 does not detect heat in the manner previously described, no current can be shunted away from the gate 60 of the silicon controlled rectifier SCR1 and SCR1 will conduct. When SCR1 conducts, current also passes through the pull-in coil RC2 of the reed switch 25 and the heater 23 of the safety switch 20. With a flux established in the coil RC2 and the coil RC1, the reed switch contacts 26 and 28 will pull-in and the triac Q1 will start the burner. If the stack switch does not detect heat, the silicon controlled rectifier will continue to conduct and the safety switch 20 will open the contacts 21 and 22 due to the heating action of the heater 23 effecting the opening of the contacts 21 and 22. If the stack switch control assembly 70 detects heat in the stack in the manner previously described, then the contacts 32 and 33 of the reed switch close and shunt current away from the gate 60 of the rectifier SCR1. SCR1 will no longer conduct, the heating coil 23 of the safety switch will be deenergized but the coil RC1 will continue to hold in the reed relay contacts 26 and 28. If the stack switch control assembly 70 detects heat and subsequently for some reason the burner flame should go out during the thermostat cycle, the rectifier SCR1 will again conduct and the heating coil 23 will be energized so as to open the contacts 21 and 22 into a lock-out condition. When the thermostatic conditions are satisfied and the contacts thereof open, the coil RC1 is deenergized thereby opening the contacts 26 and 28 and also deenergizing the triac Q1. No current is then available through the resistor R4 to energize SCR1 even though the stack switch control assembly detects no heat. It should also be understood that the same cycle would occur if the thermostat were connected to line voltage and placed in one leg of the transformer primary coil.

An important aspect of the present invention resides in the fact that if there is a failure in the system 10, the system 10 will fail is safe condition. For example, if the silicon controlled rectifier SCR1 is shorted from anode to cathode it will conduct electric current supplied by the secondary winding 16 of the transformer. The stack switch control assembly 70 will have no effect on the control sircuit. Since current through the rectifier SCR1 must also pass through the safety switch heater 23, the safety switch contacts 21 and 22 will open into a lock-out condition. The only way to start the burner again is by resetting the safety switch 20. An open circuit in the rectifier SCR1 will render the control circuit inoperative since no starting current is provided in the coil RC2. The burner will thus never start. A short circuit from the gate to the cathode of the rectifier SCR1 has the same effect as an open circuit between the anode and cathode of SCR1. An open circuit from the gate to cathode of the rectifier SCR1 also has this effect.

Failure of the diode D1 in the short circuit state causes AC voltage to appear across the capacitor C2 and since AC voltage is destructive to the capacitor C2 it will generally cause it to fail short circuited. Hence, there is no coil power to the reed switch coil RC1 and the reed switch 25 is incapable of holding. The burner would then become inoperative. If the diode D1 fails open circuited, there is likewise no power to the coil RC1 and the burner becomes inoperative.

A short circuit failure of the diode D2 reacts the same as a gate to cathode short of the rectifier SCR1 as previously described. An open circuit failure of the diode D2 will generally be destructive to the rectifier SCR1 and any failure of the SCR1 will render the control circuit inoperative as previously described.

An open or short circuit failure of the capacitor C2 will prevent the reed switch 25 from pulling in and the burner from operating. The burner will also be prevented from operating if either of the coils RC1 of RC2 of the reed switch 25 becomes open or short circuited since such failure will prevent the reed switch 25 from pulling in and closing the contacts 26 and 28.

The resistor R1 prevents accidental destruction of the diode D2 by a serviceman in the field. This could happen if a serviceman accidentally shorted one of the thermostat terminals with the proper terminal of the stack switch control assembly 70. Open circuit failure would react in the same manner as an open circuit in the reed switch 31. Short circuit of either of the resistors R1 or R2 would simply eliminate the protection measure from the equipment.

The resistor R3 is a wire wound type so that short circuit failure can be neglected. Open circuit failure of the resistor R3 would result in elimination of thermostat bias current used for conventional thermostat "pre-heaters". The resistor R3 plays no role in the circuit other than for this home comfort feature.

Continuing the description of the fail-safe operation of the system 10, if the resistor R4 is open circuited then SCR1 never receives current from gate to cathode and will never turn on. Since the rectifier SCR1 must conduct to pull in the reed switch 25 through the coil RC2, the burner will never turn on. If the burner is in the middle of a cycle when the resistor R4 fails open, then the burner will fail to start on the next cycle. If the resistor R4 fails in a short circuit condition, then neither of the coils RC1 of RC2 will be energized and the reed switch contacts 26 and 28 will not close so that the burner will be inoperative.

The resistor R5 protects the diode D1 from current surges to the capacitor C2 during normal operation. If the resistor R5 were to short circuit then the diode D1 may fail shorted and the burner would become permanently inoperative in the manner previously described in connection with failure of the D1. If the resistor R5 fails open circuited, then no power will be furnished to the coil RC1 and the reed switch contacts 26 and 28 will not close. The burner would then be inoperative.

The resistor R6 functions to limit the power to the coil RC1. The resistor R6 is calibrated and calibrates the coil RC1 to within a specified drop-out range for the reed switch 25. As is well known, wire wound resistors do not fail short. If open circuit failure results, then no power is supplied to the coil RC1 and the reed switch will not pull in. The burner will thus be inoperative if the resistor R6 fails open circuited.

The wire wound potentiometer R7 is used to calibrate the pull-in voltage of the reed switch 25. This is accomplished by shunting current away from the reed switch coil RC2. An open circuit in the potentiometer R7 allows the reed switch 25 to pull in at lower line voltage than the set-point voltage, as for example, 90 volts. Short circuit of the potentiometer R7 prevents power from flowing to the reed switch coil RC2 and the reed switch will not close the contacts 26 and 28. The burner will then be inoperative.

The heating coil of the safety switch 20 cannot fail shorted. An open circuit failure functions in the same manner as an open circuit failure of the anode to cathode on the rectifier SCR1 previously described.

Figure 9:
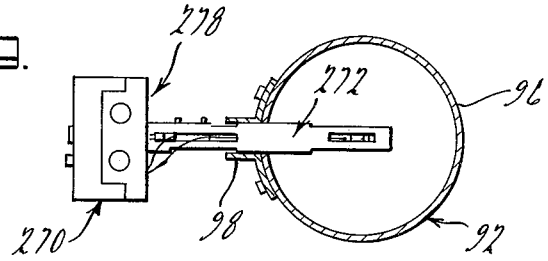
FIG. 9 is an elevational view, with portions in cross-section, of another improved stack switch embodying the present invention showing the same incorporated in the system illustrated in FIG. 1, and installed in a furnace stack.
Figure 10:
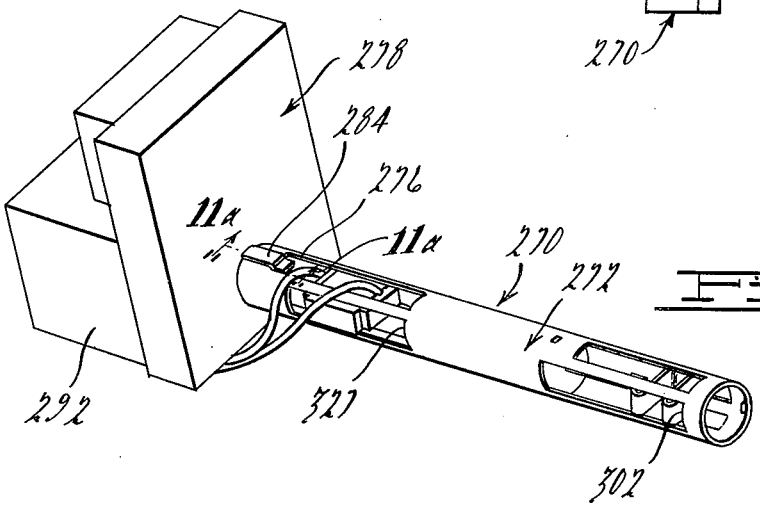
FIG. 10 is a perspective view of the switch illustrated in FIG. 9.

Another embodiment of the invention is illustrated in FIGS. 9 through 15 wherein the reed switch 31 is shown incorporated in a stack switch control assembly, generally designated 270. The stack switch control assembly 270 is comprised of an elongate tubular body 272 which is preferably formed of metal and which defines an axially extending passageway 274 that extends throughout the length of the tubular body 272. In this embodiment of the invention, as illustrated in FIGS 10 and 11A, the end portion 276 of the tubular body is secured for quick and easy connection to and release from a junction box 278, the releasable connection being accomplished by means of a generally L-shaped flange portion 279 which is formed integrally with the tubular body 272 and which projects through a slot 280 provided in the front wall 281 of the junction box whereby the free leg 282 of the flange portion 279 bears against the rear face 283 of the front wall 281. A generally Z-shaped resilient latching member 284 is also provided which is preferably formed of spring steel, the latching member 284 having a leg portion 285 which projects through a slot 286 provided in the front wall 281 of the junction box and bears against the rear face 283 thereof. In the latching position illustrated in FIGS. 10 and 11A, the central portion 287 of the latching member 284 overlies the end portion 276 of the body 272 while the right end of the latching member, as viewed in FIGS. 10 and 11A, defines a bight portion 288 that bends over and projects into an opening 289 defined by the tubular body 272 so that the bight portion 288 bears against the adjacent edge 290 defining the end of the opening 289 thereby securing the body 272 releasably to the junction box 278. With such a construction, the tubular body 272 may be easily and quickly released from the junction box by manually lifting the free end 291 of the latching member 284 after which the tubular body 272 may be swung angularly downwardly, as viewed in FIGS. 10 and 11A, so that the free leg 282 of the flange portion 279 may be moved outwardly through the slot 280 to release the tubular body 272 from the junction box 278. From the foregoing, it will be appreciated that the tubular body 272 may be quickly connected to the junction box by reversing the above described procedure.

The junction box 278, in turn, carries a housing 292 adapted to contain the transformer 12, safety switch 20, reed switch 25, the triac Q1, rectifier SCR1 and the various resistors, capacitors and diodes hereinbefore described.

The other end portion 293 of the tubular body 272 is adapted to be mounted on and project into the furnace stack 92 through which the flue gases pass, the central portion 294 of the tubular body 272 being fixed to the exterior wall 96 of the stack 92 as by the mounting bracket 98, previously described, or other suitable means effective to mount the assembly 270 on the stack 92.

Figure 11:
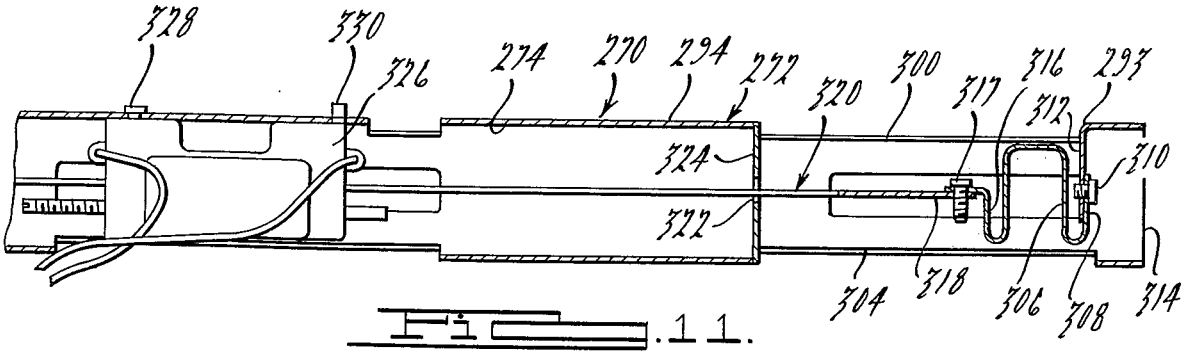
FIG. 11 is a longitudinal, cross-sectional view of a portion of the structure illustrated in FIG. 9.
Figure 11A:
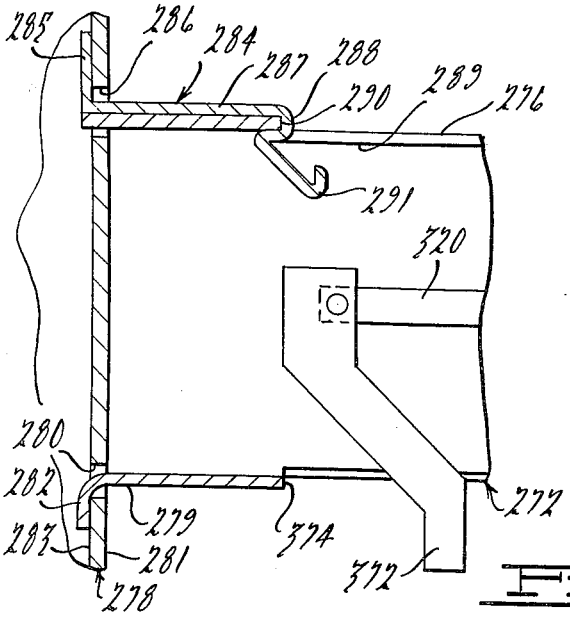
FIG. 11A is an enlarged longitudinal, sectional view of another portion of the switch illustrated in FIG. 10.

As shown in FIGS. 9, 10 and 11, the end portion 293 of the tubular body 272 which projects into the stack 92 defines equally angularly spaced, circumferentially disposed, elongate slots, such as 300, 302 and 304 which permit the flue gases to circulate through such end portion of the tubular body 272. A bimetallic actuating member 306 of generally serpentine or sinuous configuration is provided which is mounted in the passageway 274 adjacent the slots 300, 302 and 304, one end portion 308 of the bimetallic member 306 being fixed, as by a screw 310, to a flange portion 312 of the body 272 projecting into the passageway 274 at a position near but spaced from the end 314 thereof. The other end portion 316 of the serpentine bimetallic member 306 is fixed, as by a screw 317, to one end portion 318 of an elongate substantially straight drive arm 320 which is formed of magnetic material, such as steel, and which, in this embodiment of the invention, is also of rectangular cross section although, if desired, other cross sectional configurations may be utilized. The drive arm 320 extends longitudinally of the passageway 274 through an opening 322 in a bearing wall 324 carried by the body 272.

Figure 13:
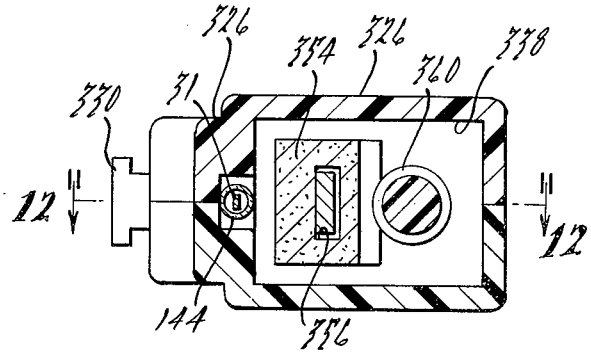
FIG. 13 is a transverse cross-sectional view of the structure illustrated in FIG. 12.
Figure 12:
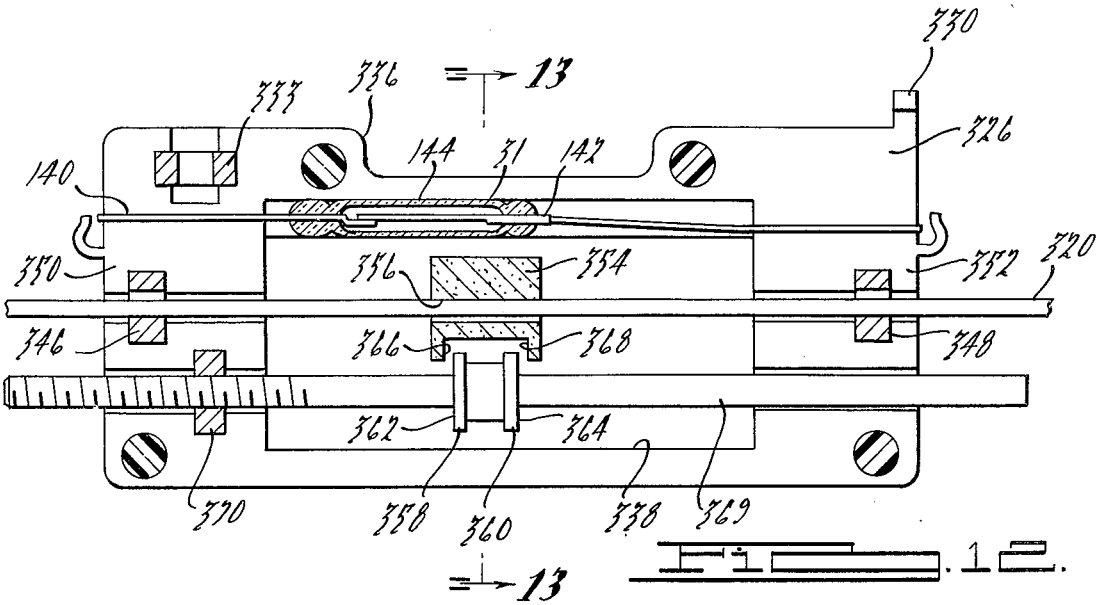
FIG. 12 is an enlarged longitudinal cross-sectional view of the switch structure illustrated in FIG. 11.

As shown in FIGS. 11, 12 and 13, a switch housing 326 is provided which may be formed of plastic or other suitable material having sufficient strength to withstand the forces exerted thereon. The switch housing 326 is mounted in the passageway 274 adjacent the end portion 276 of the tubular body 272, suitable diametrically opposed openings, such as 327, being provided in the tubular body 272 to facilitate access to the switch housing. The switch housing 326 is secured to the tubular body 272, as by a screw 328 and an integral lug 330, which pass through the outer wall of the tubular body, the screw 328 threadably engaging a nut, such as 333, embedded in the top wall 336 of the housing 326 while the lug 330 engages the outer surface of the tubular member 272. The housing 326 defines a chamber 338 in which the reed switch 31 is mounted by any suitable means, such as an adhesive, adjacent the top wall 336 as shown in FIGS. 12 and 13. As previously mentioned, the reed switch 31 is comprised of the contacts 32 and 33 which are carried by the reeds 140 and 142 hermetically sealed within the glass envelope 144. As shown in FIGS. 12 and 13, the drive arm 320 passes through the chamber 338 of the housing 326 at a position near but below the reed switch 31, the longitudinal axis of the drive arm 320 being disposed in vertical alignment with the longitudinal axis of the reed switch 31. The drive arm 320 is supported by bearing members, such as 346 and 348, carried by the end walls 350 and 352, respectively, of the housing 326.

As shown in FIGS. 12 and 13, a magnet 354 is provided which is preferably formed of ceramic or other relatively non-corrosive material. In this embodiment of the invention, the magnet 354 is also of generally cubic configuration and defines an axially extending passageway 356, the minimum cross sectional dimensions of which are greater than the maximum corresponding cross sectional dimensions of the drive arm 320, and the magnet 354 is slideably mounted on the drive arm 320 and within the chamber 338 defined by the housing 326, at a position near but slightly spaced below the reed switch 31. As shown in FIGS. 12 and 13, the drive arm 320 passes through the magnet 354 with a loose sliding fit, the magnet 354 being magnetically attracted to and magnetically gripping the drive arm 320, which, as previously mentioned, is formed of magnetic material such as steel. With such a construction, the magnet 354 magnetically clutches the drive arm 320 and moves longitudinally with the drive arm 320 but the drive arm 320 is free to move through the magnet when the forces tending to move the drive arm through the magnet are greater than the magnetic attraction between the magnet 354 and the drive arm 320.

In this embodiment of the invention, a pair of adjustable stop elements 358 and 360 are provided having abutment surfaces 362 and 364, respectively, disposed within the chamber 338 and adapted to engage abutment surfaces 366 and 368, respectively, projecting from the magnet 354 to limit the longitudinal movement of the magnet. The stop elements 358 and 360 are carried by an adjusting member 369 which extends through the housing 326 and threadably engages an internally threaded member 370 carried by the housing 326 thereby permitting manual adjustment of the relative positions of the abutment surfaces 362 and 364.

Figure 14:
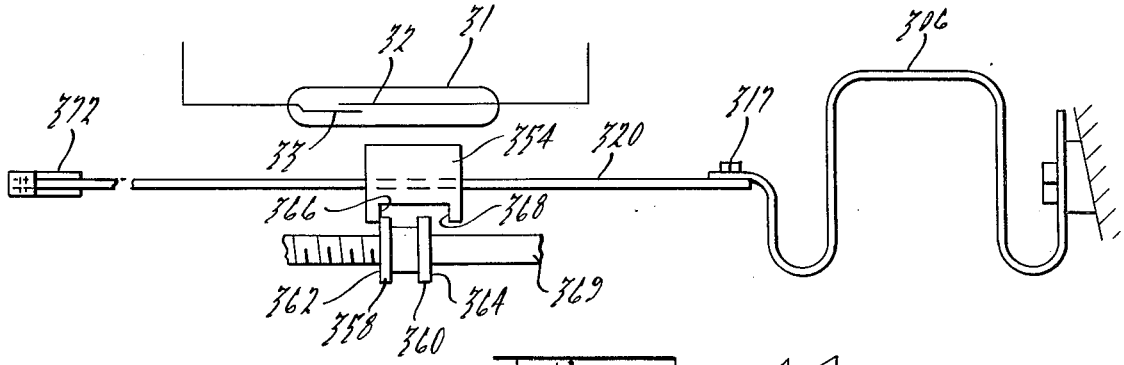

The magnet 354 also functions to open and close the contacts 32 and 33 of the reed switch 31, the reeds 140 and 142 of which are formed of magnetic material in the conventional manner. When the magnet 354 is disposed adjacent the right end of the reed switch 31 as illustrated in FIG. 12 and as schematically illustrated in FIG. 14, the contacts 32 and 33 are open. However, when the magnet 354 is disposed adjacent the left end of the reed switch 31 as schematically illustrated in FIG. 15, the magnet 354 causes the contacts 32 and 33 to close to complete an electrical circuit through the reed switch 31.

As shown in FIG. 11A, an adjusting lever 372 is provided which is fixed by any suitable means to the end of the drive arm 320 remote from the bimetallic actuating member 306, the lever 372 projecting through an opening 374 provided in the tubular body 272. With such a construction, the drive arm 320 may be easily moved longitudinally by manually pushing the lever 372 in the desired direction so as to position the magnet 354 initially in proper relationship with respect to the reed switch 31 and open or close the contacts 32 and 33 as desired whereby the contacts are in step for proper operation of the system 10, as previously described.

In FIGS. 12 and 14, the control is illustrated in the "off" mode. When the thermostat 24 calls for heat, and assuming that the burner 34 ignites and that the combustion is satisfactory, the hot gases flowing through the furnace stack 92 heat the serpentine bimetallic actuating member 306 and the serpentine bimetallic actuating member 306 moves to the left, as illustrated in FIG. 15, and moves the drive arm 320 and the magnet 354 to the position illustrated in FIG. 15. When the magnet 354 reaches the position illustrated in FIG. 15, the magnet 354 closes the contacts 32 and 33 of the reed switch 31 to complete an electrical circuit therethrough and turn off the safety switch 20. As the serpentine bimetallic actuating member 306 becomes hotter, the bimetallic actuating member 306 and the drive arm 320 continue to move to the left, as viewed in FIG. 15, but the magnet 354 remains against the abutment surface 364 to maintain the contacts 32 and 33 closed, the drive arm 320 declutching from and slipping through the magnet 354 since the forces tending to move the drive arm 320 through the passageway 356 defined by the magnet 354 are greater than the magnetic attraction between the magnet 354 and the drive arm 320. The drive arm 320 is thus free to move longitudinally for any desired distance while the magnet 354 moves with the drive arm only between the limits set by the adjustable abutment surfaces 362 and 364.

Figure 15:
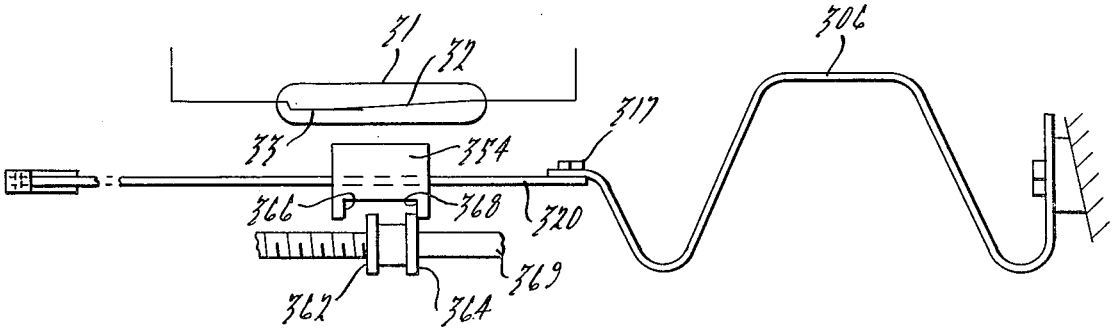
FIG. 15 is a schematic view similar to FIG. 14, illustrating the switch in the closed position.

Assuming that a flame failure occurs while the magnet 354 is disposed in the position illustrated in FIG. 15, the serpentine bimetallic actuating member 306 begins to cool and the actuating member 306 and the drive arm 320 move to the right, as viewed in FIG. 14. The magnet 354 moves with the drive arm due to the magnetic attraction therebetween and when the magnet 354 reaches the position illustrated in FIG. 14, the contacts 32 and 33 open causing the safety switch 20 to energize as hereinbefore described. The movement of the magnet 354 to the right, as viewed in FIG. 14, is, of course, limited by the adjustable abutment surface 366 so that the magnet is maintained in the desired position for proper resetting. From the foregoing it will be appreciated that the magnet 354 also provides damping as well as clutching in addition to actuation of the reed switch 31.

From the foregoing description, it will be appreciated that the stack switch control assemblies 70 and/or 270 may be marketed in the form of a universal service kit which can be used to replace a worn out or defective stack switch control or a cadmium cell flame detector type primary control, or a stack switch type to cadmium cell flame detector type conversion may be made utilizing a conventional cadmium cell flame detector which may be mounted adjacent the furnace burner and electrically connected in the system 10 in the circuit occupied by the reed switch 31. When such a conversion is made, the components housed within the tubular members 72 or 272 may be removed and a dummy tube 72 or 272 mounted in the furnace stack in the manner previously described.

While preferred embodiments of the invention have been illustrated and described, it will be understood that various changes and modifications may be made without departing from the spirit of the invention.

What is claimed is:

1. In a stack control system for furnaces, the combination including burner control means adapted to be connected to a main line source of AC current, a low voltage control circuit including thermally activated, magnetically operated heat detection means, said heat detection means including a bimetallic actuating member movable in response to thermal changes, a reed switch, and magnetic means movable in response to movement of said actuating member and effective to actuate said reed switch, said magnetic means including a magnetic body defining an opening therethrough, a drive arm formed of magnetic material and extending through the opening defined by said magnetic body whereby said magnetic body is magnetically clutched to said drive arm, one end portion of said drive arm being fixed to said actuating member, stop means limiting movement of said magnetic body relative to said reed switch while permitting de-clutching of said magnetic body with respect to said drive arm and continued movement of said drive arm relative to said magnetic body, means in said low voltage control circuit including solid state means effective to actuate said burner control means, circuit interrupting means effective to interrupt the flow of current from said main line source of AC current, and means controlled by said heat detection means controlling the actuation of said circuit interrupting means.

2. In a stack control system for furnaces, the combination including burner control means adapted to be connected to a furnace burner connected to a main line source of AC current, a low voltage control circuit including thermally actuated, magnetically operated heat detection means, said heat detection means including a bimetallic actuating member movable in response to thermal changes, a reed switch, and magnetic means movable in response to movement of said actuating member and effective to actuate said reed switch, said magnetic means including a magnetic body defining an opening therethrough, a drive arm formed of magnetic material and extending through the opening defined by said magnetic body whereby said magnetic body is magnetically clutched to said drive arm, one end portion of said drive arm being fixed to said actuating member, stop means limiting movement of said magnetic body relative to said reed switch while permitting de-clutching of said magnetic body with respect to said drive arm and continued movement of said drive arm relative to said magnetic body, means in said low voltage control circuit including solid state means effective to actuate said burner control means, circuit interrupting means controlled by said heat detection means and effective to control the flow of current from said main line source of AC current, and means interfacing between said low voltage control circuit and said burner control means.

3. In a stack control system for furnaces, the combination including burner control means adapted to be connected to a main line source of AC current, a low voltage control circuit including thermally actuated, magnetically operated heat detection means, said heat detection means including an elongate tubular body defining an axially extending passageway, one end portion of said tubular body being adapted to project into a furnace stack, a bimetallic actuating member of sinuous configuration mounted in said passageway in said one end portion of said tubular body, said bimetallic actuating member being movable in response to changes in temperature, a reed switch mounted in said passageway at a position remote from said one end portion of said tubular body, magnetic means disposed adjacent said reed switch and movable in response to movement of said actuating member to actuate said reed switch, said magnetic means including a magnetic body defining an opening therethrough, a drive arm formed of magnetic material and extending through the opening defined by said magnetic body whereby said magnetic body is magnetically clutched to said drive arm, one end portion of said drive arm being fixed to said actuating member, means for manually moving said drive arm, stop means limiting movement of said magnetic body relative to said reed switch while permitting de-clutching of said magnetic body with respect to said drive arm and continued movement of said drive arm relative to said magnetic body, means in said low voltage control circuit including solid state means effective to actuate said burner control means, circuit interrupting means effective to interrupt the flow of current from said main line source of AC current, and means controlled by said heat detection means controlling the actuation of said circuit interrupting means.

4. In a stack switch control assembly, the combination including an elongate tubular body defining an axially extending passageway, one end portion of said body being adapted to project into a furnace stack, a bimetallic actuating member mounted in said passageway in said one end portion of said body, said bimetallic actuating member being movable in response to changes in temperature in a furnace stack, a reed switch mounted in said passageway at a position remote from said one end portion of said body, magnetic means mounted in said passageway adjacent said reed switch and movable in response to movement of said actuating member to actuate said reed switch, said magnetic means including a magnetic body defining an opening therethrough, a drive arm formed of magnetic material and extending through the opening defined by said magnetic body whereby said magnetic body is magnetically clutched to said drive arm, one end portion of said drive arm being fixed to said actuating member, and stop means limiting movement of said magnetic body relative to said reed switch while permitting de-clutching of said magnetic body with respect to said drive arm and continued movement of said drive arm relative to said magnetic body.

5. In a stack switch control assembly, the combination including an elongate tubular body defining an axially extending passageway, one end portion of said tubular body being adapted to project into a furnace stack, a junction box, resilient means releasably connecting the other end portion of said tubular body to said junction box, a bimetallic actuating member of sinuous configuration mounted in said passageway in said one end portion of said tubular body, said bimetallic actuating member being movable in response to changes in temperature in a furnace stack, a reed switch mounted in said passageway at a position remote from said one end portion of said body, magnetic means mounted in said passageway adjacent said reed switch and movable in response to movement of said actuating member to actuate said reed switch, said magnetic means including a magnetic body defining an opening therethrough, a drive arm formed of magnetic material and extending through the opening defined by said magnetic body whereby said magnetic body is magnetically clutched to said drive arm, one end portion of said drive arm being fixed to said actuating member, means for manually moving said drive arm, and stop means limiting movement of said magnetic body relative to said reed switch while permitting de-clutching of said magnetic body with respect to said drive arm and continued movement of said drive arm relative to said magnetic body.

6. The combination as set forth in claim 5, said stop means engaging said magnetic body intermediate the ends thereof.

7. The combination as set forth in claim 5, said means for manually moving said drive arm including a lever fixed to said drive arm and projecting radially outwardly from said tubular body.

* * * * *